United States Patent [19]

Wolf

[11] 4,113,254

[45] Sep. 12, 1978

[54] GAME WITH TOY HAVING ROTATING AND STRAIGHT-LINE MOVEMENT

[76] Inventor: Tobin Wolf, 285 Aycrigg Ave., Passaic, N.J. 07055

[21] Appl. No.: 767,970

[22] Filed: Feb. 11, 1977

[51] Int. Cl.[2] ..... A63B 71/04; A63H 29/20

[52] U.S. Cl. ..... 273/108; 46/209; 46/211; 273/138 R; 273/276

[58] Field of Search ..... 46/50, 211, 209, 202; 273/108, 138 R, 138 A

[56] References Cited

U.S. PATENT DOCUMENTS

| | | | |
|---|---|---|---|
| 459,997 | 9/1891 | Cromwell | 273/108 |
| 499,317 | 6/1893 | Burch | 273/108 |
| 1,893,121 | 1/1933 | Alger | 273/108 |
| 3,429,573 | 2/1969 | Cederberg | 273/108 |
| 3,955,429 | 5/1976 | Holden | 46/209 |

FOREIGN PATENT DOCUMENTS

| | | | |
|---|---|---|---|
| 921,738 | 7/1949 | Fed. Rep. of Germany | 273/108 |
| 938,173 | 1/1956 | Fed. Rep. of Germany | 46/209 |

*Primary Examiner*—Richard C. Pinkham
*Assistant Examiner*—Lawrence E. Anderson
*Attorney, Agent, or Firm*—Jay M. Cantor

[57] ABSTRACT

A child's game which comprises a toy capable of spinning in a circular motion or path and then travelling in a straight or substantially straight line at the end of its travel path and an arena which is provided with a wall surrounding the arena perimeter, the wall having a single opening therein through which a toy can travel, the arena also having a central start area and other designated areas therewithin for use in playing the game. The designated areas can be sectors, one side of which is an arc formed by the wall and the perimeter of the arena. Each of the sectors has a predetermined designation in accordance with the rules of the game. The toy has a set of wheels which, upon being caused to rotate at high speed, causes a flywheel within the toy to rotate, raise one wheel from the arena surface, and permit the toy to travel in a circular path when placed in the center of the arena until the flywheel has reduced its speed to some predetermined point whereupon both of the wheels are on the ground and the toy will then travel in a straight path. The toy will either travel out of the arena through the opening in the perimeter wall or it will move forward and bump into the wall and land in one of the sectors.

4 Claims, 4 Drawing Figures

GAME WITH TOY HAVING ROTATING AND STRAIGHT-LINE MOVEMENT

BACKGROUND OF THE INVENTION

This invention relates to a simple child's game that requires no reading skill and can be played by preschool children.

The toy industry is constantly on the lookout for simple, relatively inexpensive games which can be easily mass-produced. In accordance with the present invention there is provided a child's game which meets these criteria utilizing a unique arrangement of elements.

Briefly, in accordance with the present invention, a child's game is provided which comprises a toy capable of spinning in a circular motion or path and then travelling in a straight or substantially straight line at the end of its travel path and an arena which is provided with a wall surrounding the arena perimeter, the wall having a single opening therein through which a toy can travel, the arena also having a central start area and other designated areas therewithin for use in playing the game. The designated areas can be sectors, one side of which is an arc formed by the wall at the perimeter of the arena. Each of the sectors has a predetermined designation in accordance with the rules of the game. The toy has a set of wheels which, upon being caused to rotate at high speed, causes a flywheel within the toy to rotate, raises one wheel from the arena suface, and permits the toy to travel in a circular path when placed in the center of the arena until the flywheel has reduced its speed to some predetermined point whereupon both of the wheels are on the ground and the toy will then travel in a straight path. The toy will either travel out of the arena through the opening in the perimeter wall or it will move forward and bump into the wall and land in one of the sectors.

Assuming that the toy is in the form of a mouse, several sectors can be designed to provide wedges of cheese in varying numbers with other sectors providing penalities. The game can be won by landing the mouse on sectors having predetermined numbers of cheese wedge designations whereby a wheel of cheese can be completed by the winning player before landing on a penalty sector.

It is therefore an object of this invention to provide a relatively simple child's game which requires no reading skills.

It is a further object of this invention to provide a simple child's game which can be produced relatively inexpensively and be capable of relatively long use, even with the abuse and handling thereto by children.

The above objects and still further objects of the invention will immediately become apparent to those skilled in the art after consideration of the following preferred embodiment thereof, which is provided by way of example and not by way of limitation, wherein.

Figure 1:
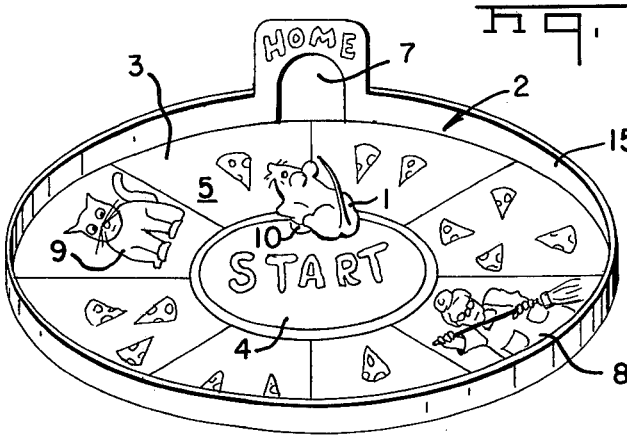
FIG. 1 is a three-dimensional view of a gameboard in accordance with the present invention and a toy for use in conjunction with the gameboard.
Figure 2:
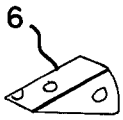
FIG. 2 is a simulated wedge of cheese.
Figure 3:
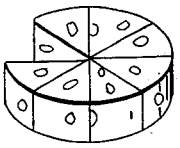
FIG. 3 is a plurality of wedges of cheese as in FIG. 2 arranged to form a wheel of cheese.

Referring now to FIG. 1, there is shown a mechanical mouse 1 within an arena 2 having a perimeter wall 15 with an opening 7 in the wall sufficiently large to allow the mouse 1 to travel therethrough. The interior of the arena 2 includes a bottom 3, the bottom 3 including a start circle 4 at the center of the arena and a plurality of sectors 5 extending outwardly from the start circle 4 to the wall 15. The arena may be formed as a single plastic part including the floor 3, the wall 15, and the opening 7, or the floor 3 may be a separate cardboard or plastic sheet affixed to or placed under the wall 15. In addition, the mouse 1 can be another appropriate animal or object. Each of the sectors of the bottom 3 has predetermined designations therein. As shown in FIG. 1, the sectors can have one, two, three or four wedges of cheese depicted thereon with the farmer's wife depicted in sector 8 and a cat depicted in sector 9. In addition, a plurality of wedge shaped pieces of simulated cheese 6 as shown in FIG. 2 is provided with the game for use as will be described hereinbelow. The wedge shaped pieces of simulated cheese 6 can be arranged to form a complete wheel of cheese as shown in FIG. 3.

As will be explained hereinbelow, the mouse includes a pair of wheels 10 and 10′ (better shown in FIG. 4) so that when the mouse is moved rapidly in a forward direction across a hard surface, the wheels 10 and 10′ will be caused to rotate. When the mouse is then placed in the start circle 4, it will run rapidly in a circular path for a while and then, finally, when the speed of the wheels 10 and 10′ decreases to some predetermined speed, run in a straight line out of the start circle 4 and into one of the sectors 5. The mouse will then either strike against the wall 15 and either remain there or travel along the wall or, alternatively, pass through the aperture 7 out of the arena.

Each of the sectors 5 is illustrated with a number of wedges of cheese to be won or lost by a player if the mouse stops in that sector. In addition, if the mouse escapes through the aperture 7, this could be an instant win whereas an instant loss can be provided if the mouse enters the sector illustrated by the farmer's wife 8 or the cat 9. The rules could further be altered by making all or some pieces of cheese collected by landing on sectors 5 to be returned with the player starting over when landing in one of the sectors 8 or 9. The object is to be the first player to collect enough pieces or wedges of cheese 6 in order to be able to form a complete wheel as shown in FIG. 3 to be the winner.

Figure 4:
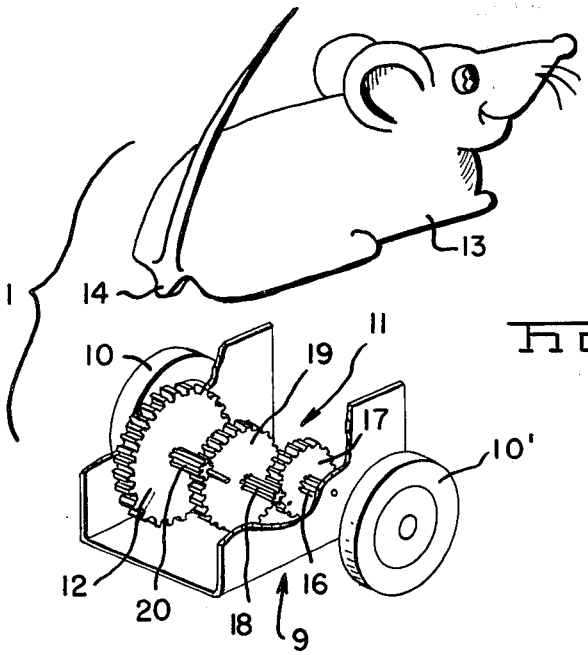
FIG. 4 is an exploded view of the mouse shown in FIG. 1.

The mechanism for causing the mouse 1 to travel in an initial circular path and then a straight path is well known in the prior art and will be described in detail hereinbelow. With reference to FIG. 4, the mouse 1 includes a friction motor 9 positioned within the mouse body 13. This motor design is well known in the toy art. It comprises a pair of wheels 10 and 10′ connected to a flywheel 12 by a gear train 11 composed of gears 17 to 20. The wheel 10′ is coupled to shaft 16 which extends through to wheel 10. A flywheel 12 is connected to the gear 20 and is integral therewith. Gear 20 is driven by gear 19 which is integral with gear 18. Gear 18 is driven by gear 17 which is integral with shaft 16. Therefore, when the wheels 10 and 10′ of the friction motor are moved along the hard surface so that the wheels are rotated by frictional contact with said surface, a rapid rotation is imparted to the flywheel 12 from the shaft 16 which is coupled to gear 17 via gears 18, 19 and 20. This causes the flywheel 12 to move or rotate at a much more rapid rate than the wheels 10 and 10′ due to the gear ratios. When the friction motor 9 is thereafter placed on a surface and released, the energy stored in the flywheel is transmitted back to the wheels and the friction motor along with the mouse body 13 which is mounted on the motor is momentarily forwardly propelled.

Assuming that the friction motor 9 by itself or in combination with the body 13 can freely turn left or right since the tail skid 14 on body 13 does not have sufficient friction to inhibit turning, and that the weight of the friction motor and body 13 is sufficiently light relative to the mass of the flywheel, then it is an observable phenomenon that the friction motor, with or without the body 13 will behave in an unusual manner.

If a sufficiently high rotational velocity is imparted to the flywheel 12, the friction motor 9, with or without the body 13, will run in a circular path until the speed of the flywheel diminishes to the point where its gyroscopic influence is less than the weight of the friction motor and body, at which time the friction motor will suddenly leave its circular path and move in a straight line.

It would appear that the initial tendency of the friction motor to run in a circular path is contrary to gyroscopic behavior since the rapidly spinning flywheel placed "squarely" on the table should tend to maintain a vertical posture and travel in a straight line. However, in practice, it is virtually impossible to place the friction motor down "squarely". Moreover, the typical friction motor for a toy is constructed of imprecise stampings and the toy wheels have measurable eccentricity. In addition, the flywheel is typically off center as shown in FIG. 4, placing a greater driving force on the nearest driving wheel 10. All of these factors tend to create an initial tilt and/or turn, thus initiating gyroscopic precession that maintains the tilt and turns the entire motor 9 until the velocity of the flywheel subsides. For these reasons, and perhaps others, it can be observed that when the energized friction motor 9 is released in the arena, it will immediately turn as the flywheel tilts, lifting the wheel 10' off of the bottom 3 of the arena. This will continue until the velocity of the flywheel sufficiently subsides. For example, as the friction motor turns to the right, the flywheel tilts to the left and the right wheel 10' will rise off the bottom 3. This is in accord with true gyroscopic behavior.

It can therefore be seen that the mouse 1, after having the flywheel 12 rotated to a sufficiently high speed, will travel in a circular path, preferably in the start area 4, until the flywheel has subsided in speed sufficiently whereupon both of the wheels 10 and 10' will be on the bottom 3 of the arena 2, thereby causing the mouse 1 to travel in a straight path. The mouse will then either travel out of the arena through the opening 7 or will stop in one of the sectors within the arena.

The player will receive a number of simulated wedges of cheese 6 in accordance with the number shown in the sector in which the mouse lands. If the player can accumulate a sufficient number of wedges of cheese to form a wheel of cheese as shown in FIG. 3, he will be the winner. If the mouse, on the other hand, lands on one of the penalty sectors 8 and/or 9, the appropriate penalty is assessed such as loss of the game or return of wedges of cheese accumulated to date.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations and modifications.

What is claimed is:

1. A game which comprises a gameboard and a toy for use in conjunction with said gameboard, said gameboard comprising, (a) a bottom surface, said bottom surface comprising a central start region and a plurality of sectors extending from said central start region and terminating at the perimeter of said bottom surface, (b) a wall secured to said bottom surface and extending along the entire perimeter of said bottom surface said wall including an aperture therein extending to said bottom surface, (c) a toy having a vertical cross-section at all points less than a vertical cross-section through said aperture, said toy comprising a body having skid means positioned for frictional engagement with said bottom surface and motor means within said body including a pair of wheels for engagement with said bottom surface, and means responsive to first predetermined rotational speeds of said wheels for causing only one of said wheels to lift off said bottom surface and cause said motor means to rotate in a circle about said skid means and responsive to second predetermined lower rotational speeds of said wheels for causing said motor means to travel in a substantially straight line, said toy being responsive to said straight travel, for movement towards said wall to stop in one of said sectors or to travel through said aperture in said wall.

2. A game as set forth in claim 1 wherein said wall and said bottom surface are a unitary member.

3. A game as set forth in claim 1 wherein said bottom surface is circular, said central start area is a circle at the center of said bottom and said sectors are formed by radial straight lines on said bottom between said wall and said start area.

4. A game as set forth in claim 2 wherein said bottom surface is circular, said central start area is a circle at the center of said bottom and said sectors are formed by radial straight lines on said bottom between said wall and said start area.

* * * * *